United States Patent [19]

Röck et al.

[11] Patent Number: 4,786,123

[45] Date of Patent: Nov. 22, 1988

[54] DRAWER

[75] Inventors: Erich Röck, Höchst; Felix Schwärzler, Hohenems, both of Austria

[73] Assignee: Julius Blum Gesellschaft m.b.H., Höchst, Austria

[21] Appl. No.: 124,689

[22] Filed: Nov. 24, 1987

[30] Foreign Application Priority Data

Dec. 9, 1986 [AT] Austria ..... 3253/86

[51] Int. Cl.[4] ..... A47B 88/00

[52] U.S. Cl. ..... 312/341 R; 312/330 R

[58] Field of Search ..... 312/349, 350, 330, 341 R

[56] References Cited

U.S. PATENT DOCUMENTS 2,488,916 11/1949 Johnson ..... 312/349

2,739,028 3/1956 Siggia ..... 312/350 X 2,847,263 8/1988 Osborne ..... 108/27

2,961,284 11/1960 Sturm ..... 312/350

2,991,141 7/1961 Houck ..... 312/341 R

*Primary Examiner*—Joseph Falk

*Attorney, Agent, or Firm*—Wenderoth, Lind & Ponack

[57] ABSTRACT

A drawer includes a bottom, a rear wall, a front plate and two side walls. Each side wall includes separates a lower and upper parts which are anchored to each other by means of a downwardly extending flange of the upper part. The lower part is made of an organic material, for example plastics material or chip board. The upper part is formed by a metal profile having a substantially U-shaped configuration including upper and lower running flanges defining a running groove for a runner roller at the side of a furniture body. A roller carrier is connected to the upper part and is mounted on to the rear wall of the drawer.

11 Claims, 2 Drawing Sheets

1
2
3
4
5
6
III
III 3
5
6
7
8
9
10
11
16
17
18
20
21

DRAWER

FIELD AND BACKGROUND OF THE INVENTION

The invention relates to a drawer having a bottom, a rear wall, a front plate and two side walls each including a lower part and an upper part which are anchored to each other. The lower part is made of an organic material, for example wood, while the upper part is formed by a metal profile and has a substantially U-shaped configuration including upper and lower running flanges defining a running groove for a runner roller at the side of the body of an article of furniture.

In modern drawers, many different materials are used for the side walls. Originally the side walls were made of wood and later of plates manufactured of wood materials, for example chipboard. Lately, drawer side walls of plastics material have been used more frequently. A further step in the manufacture of drawers was the use of metal drawer side walls of sheet steel which not only formed the side wall but which also formed the running grooves or running flanges for runner rollers at the side of the furniture body.

Such metal drawer side walls are characterized by a high loading capacity and satisfactory functional features (good guiding of the drawer, smooth running etc.).

In many cases the aestethic appearance of metal drawer side walls are not satisfactory. In general, drawers of a wood-like character are still desired by consumers in the furniture industry.

SUMMARY OF THE INVENTION

It is therefore the object of the invention to provide a drawer which offers the manufacturer more flexibility in the production of drawers.

According to the invention this object is achieved by providing the upper part of the lower running flange with a downwardly directed flange, preferably having a toothed profile, which is fit into a groove in the lower part, and by positively connecting the rear end of the upper part with a separate roller carrier, which is for example made of die cast zinc and which is fastened to the rear wall, for example screwed thereto.

A narrow aluminum profile would in many cases not be able to resist the loads acting at the bearing points of the runner roller. The invention takes, in an optimum manner, advantage of different materials and combines the same. In the arrangement according to the invention the lower part is a chipboard, for example, which substantially contributes to the aestethic appearance of the drawer. The upper part is formed by an aluminum profile which involves low manufacturing costs, which may for example be made of an extruded profile and has excellent running characteristics. The runner roller is supported by a roller carrier which is made of die cast zinc, so that the great forces which are produced in this region can be taken up in an optimum manner. In this arrangement it is important that the roller carrier is aligned by the upper part, because the upper and lower parts are fitted into each other, although not fastened to the upper part but to the rear wall of the piece of furniture to provide an optimum force diversion.

It is advantageously provided that the roller carrier has a groove into which the downwardly directed flange of the upper part projects, and that the roller carrier is provided with a guiding or projection which projects into the running groove of the upper part and abuts at the vertical flange defining the running groove, preferably at the upper edge thereof.

The manufacture of very broad drawers is possible by means of the present invention because space is used in an optimum manner. The U-shaped profile of the upper part may form the running groove without being excessively broad. By comparison, a drawer side wall of chipboard, into which a groove is milled to receive the running rail of a pull-out guide assembly, is substantially broader. This is also true for drawers which are made of plastics material. The greatest part of the drawer side wall is nevertheless formed by the lower part for which a material corresponding to the desired aestethic characteristics can be chosen without taking loading capacity into particular consideration.

The metal profile of the upper part is advantageously of extruded aluminum.

An embodiment of the invention provides that the upper longitudinal edge of the upper part flush with the upper edge of the front plate.

BRIEF DESCRIPTION OF THE DRAWINGS

In the following an embodiment of the invention will be described in more detail with reference to the accompanying drawings, in which.

DESCRIPTION OF THE PREFERRED EMBODIMENT

Figure 1:
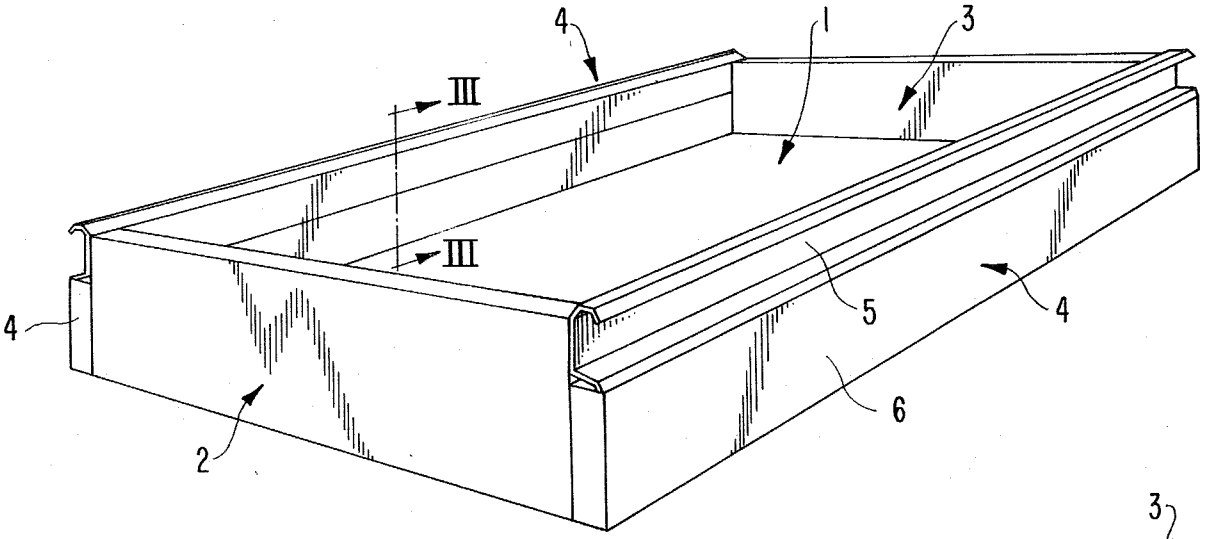
FIG. 1 is a perspective view of a drawer according to the invention.
Figure 2:
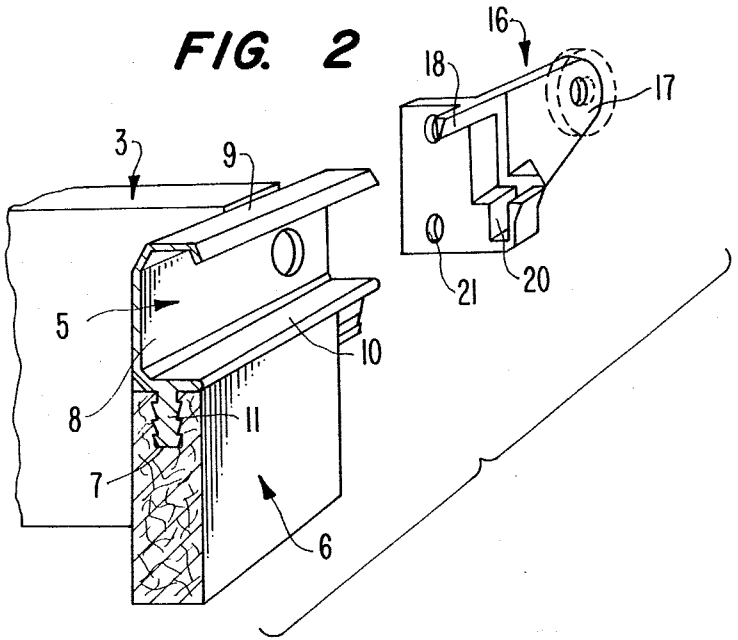
FIG. 2 is a perspective view of a rear upper corner of the drawer.
Figure 4:
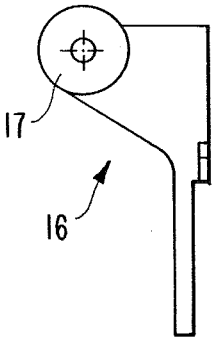
FIG. 4 is a side view of roller carrier.
Figure 5:
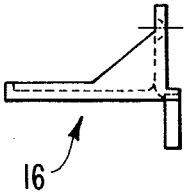
FIG. 5 is a top view of the roller carrier.
Figure 3:
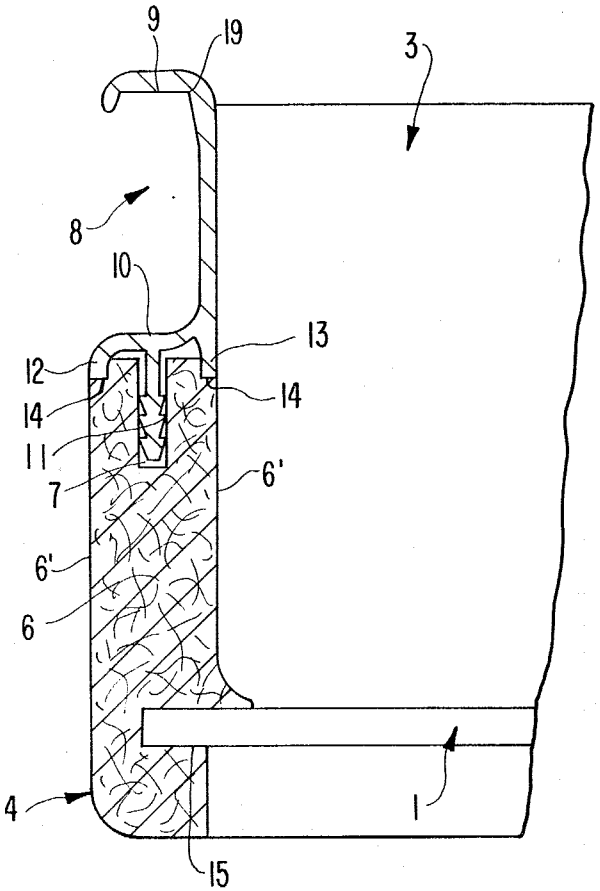
FIG. 3 is a sectional view along line III—III of FIG. 1.

The drawer which will be described comprises in a manner known per se a bottom 1, a front plate 2, a rear wall 3 and two side walls 4.

According to the invention each side wall 4 comprises an upper part 5 and a lower part 6.

The lower part 6 extends over a great part of the height of the drawer side wall 4 and is for example of plastics material or a chipboard.

The lower part 6 has a longitudinal groove 7 at its upper end.

In the illustrated embodiment, the upper part 5 is formed by an aluminum U-shaped member having a running groove 8 for a runner roller in said aluminium profile. The running groove 8 is limited by an upper running flange 9 and by a lower running flange 10.

A flange 11 which has a toothed profile is formed with the lower running flange 10 and projects into the groove 7 of the lower part 6 when the drawer is in the mounted position, the upper part 5 thus being connected with the lower part 6.

The upper part 5 further comprises an outer side flange 12 and an inner side flange 13 which extend flush with respective outer and inner surfaces 6' of the lower part 6 and which fit into respective recesses 14 therein.

The lower part 6 has a groove 15 into which is inserted the drawer bottom 1.

A roller carrier 16 which carries a runner roller 17 at the side of the drawer is arranged at the rear end of the upper part 5 which projects beyond the lower part 6 and the rear wall 3 of the drawer.

The roller carrier includes a guiding finger or projection 18 which is fitted into the running groove 8 of the upper part 5 and abuts with a rear upper edge 19 of the running groove 8, thus forming an additional centering for the roller carrier 16.

The actual centering is formed by a groove 20 into which the flange 11 is inserted in the mounted position. The roller carrier 16 is hence safely aligned with respect to the upper part 5.

The roller carrier 16 is fastened to the rear wall 3, for example by means of screws which project through fastening holes 21.

The furniture parts at the side of the furniture body, for example the supporting rail of a guide assembly and a runner roller at the side of the furniture body, are not shown in the drawings, as they are manufactured in a manner known in the state of the art.

What is claimed is:

1. In a drawer including a bottom, a rear wall, a front plate and two side walls, the improvement wherein each said side wall comprises:

a lower part made of an organic material, said lower part having formed therein an upwardly open groove;

an upper part made of metal and having a substantially U-shaped configuration including upper and lower flanges defining a running groove and a downwardly projecting flange extending from said lower flange and fitting into said upwardly open groove in said lower part, thereby anchoring said upper part to said lower part; and a roller carrier attached to said rear wall, said roller carrier having formed therein a groove into which fits a rear end of said downwardly projecting flange of said upper part, and said roller carrier having extending forwardly therefrom a guiding projection extending into said running groove.

2. The improvement claimed in claim 1, wherein said lower part is made of wood.

3. The improvement claimed in claim 1, wherein said lower part is made of chipboard.

4. The improvement claimed in claim 1, wherein said lower part is made of plastic material.

5. The improvement claimed in claim 6, wherein said upper part is made of extruded aluminum.

6. The improvement claimed in claim 1, wherein said downwardly projecting flange has a toothed configuration.

7. The improvement claimed in claim 1, wherein said guiding projection abuts with an upper edge of a vertical flange of said upper part joining said upper and lower flanges thereof.

8. The improvement claimed in claim 1, wherein said roller carrier is made of die cast zinc.

9. The improvement claimed in claim 1, wherein said roller carrier is attached to said rear wall by screws.

10. The improvement claimed in claim 1, wherein the upper edge of said upper part extends flush with the upper edge of said front plate.

11. The improvement claimed in claim 1, wherein said upper part further includes inner and outer side flanges extending downwardly into respective recesses formed in said lower part.

* * * * *